United States Patent [19]

Simanowitz

[11] Patent Number: 4,692,745

[45] Date of Patent: Sep. 8, 1987

[54] CREDIT CARD ALARM

[76] Inventor: Solly Simanowitz, 6009 Bellevue Ave., La Jolla, Calif. 92037

[21] Appl. No.: 812,520

[22] Filed: Dec. 23, 1985

[51] Int. Cl.[4] ..... G08B 21/00

[52] U.S. Cl. ..... 340/568; 340/570; 340/571

[58] Field of Search ..... 340/568, 570, 571, 555, 340/600

[56] References Cited

U.S. PATENT DOCUMENTS

| | | | |
|---|---|---|---|
| 2,708,747 | 5/1955 | Moon | 340/568 |
| 3,930,249 | 12/1975 | Steck et al. | 340/600 |
| 3,959,789 | 5/1976 | McGahee | 340/568 |
| 4,242,670 | 12/1980 | Smith | 340/568 |
| 4,480,250 | 10/1984 | McNeely | 340/568 |

*Primary Examiner*—Glen R. Swann, III

*Attorney, Agent, or Firm*—Frank D. Gilliam

[57] ABSTRACT

An alarm system for a wallet (or briefcase) includes a normally-closed mechanical switch in series with a light sensitive switch, a source of current, and an audio alarm. When the wallet (or briefcase) is open, the light sensitive switch is exposed to light and is thus "open" to prevent current flow. When the wallet (or briefcase) is closed, the light sensitive switch is shielded from light and is thus "closed" to allow current flow. The mechanical switch is held open by the presence of a credit card (or a file folder, etc.). Thus if the wallet (or briefcase) is closed while the credit card (or file folder, etc.) is absent, both switches are closed and the audio alarm is actuated. In a second embodiment, a photosensitive switch actuates an alarm when exposed to light to signal an open drawer.

7 Claims, 8 Drawing Figures

CREDIT CARD ALARM

BACKGROUND OF THE INVENTION

The invention is directed to an audio alarm device which is energized to provide an audible signal under certain conditions and more particularly to an audio alarm device small enough to be concealed in a container such as a wallet, billfold, briefcase, drawer of the like which will audibly warn a person in the presence of the wallet, billfold, briefcase, drawer or the like that an object normally there has been removed and not returned to the container.

Credit cards are well known and widely used by a great number of people. Generally most credit card users have a plurality of different types of credit cards. As a general rule a person having one or more credit cards carry those cards in a portion of their wallet or billfold in a location designated to receive and store a plurality of cards. One such portion is an area of elongated slots within the wallet which are staggered vertically between the normal bottom and top of the wallet or billfold. To use a selected card, the card is removed from its designated slot and delivered to a person that is using the card for recording the sale or a payment. It is not uncommon for customers then to replace the wallet or billfold in a pocket, purse or the like without returning the credit card to its designated slot. The loss of the card is generally not discovered until its use is again required.

A device used for this purpose is taught by U.S. Pat. No. 4,480,250. This Patent teaches a credit card carrier which includes a pair of flaps foldable upon each other. Each of the flaps carries a pair of spaced apart clip switches adapted for receiving credit cards therein. The clip switches are arranged in parallel interconnection with each other, and in series interconnected between a magnetically operated reed switch, a battery and an alarm. When a credit card is missing from one of the clip switches, and the magnetically operated switch is closed by the folding together of the flaps, the circuit between the battery and alarm is completed and the alarm is energized. This device is effective for the purpose for which it is designed that is detecting a missing credit card when the opposing flaps are closed over one another. The unit is bulky and requires that the magnetically operated switch and actuating magnet be carefully positioned so that the switch will change state when the flaps are folded together. The carrier assembly including the hanger, flaps, etc. is relatively economically expensive to construct. The flaps are formed by fiberboard or the like which results in a stiff non body conforming credit card holder. This type of device could not be conveniently carried in the hip pocket of the user. There is no teaching for use of the device for any other purpose other than with credit cards.

The present invention provides for a practical alarm device which overcomes the deficiencies of the above referenced device and others in this art.

SUMMARY OF THE INVENTION

The present invention is primarily designed, as is the cited reference, for use as a device for detecting the absence of a credit card or other valuable objects from a particular location in the wallet, billfold, briefcase, drawer of the like. The device can be adapted to a conventional wallet, billfold, briefcase, drawer or the like and its components, although rigid, are not bound together on a common rigid surface and, therefore, a container such as a wallet or billfold to be placed in the hip pocket of the user where it will conform to the adjacent body contour.

The device of the present invention can utilize a battery as a power source or a photovoltaic cell which when exposed to a light source provides operating voltage. When the device is used to indicate a missing object such as a credit card, a light sensitive circuit is employed which opens the electrical circuit between the power source and audio alarm when exposed to light energy rendering the device inoperative. When the device is used to indicate an open desk drawer of the like, when exposed to light energy, the light sensing circuit completes the electrical circuit between the power source and the audio alarm which causes the alarm to sound when the desk drawer is opened.

On the one hand, the alarm is designed to sound in the absence of light and on the other hand the alarm is designed to sound in the presence of light.

An object of this invention is to provide an alarm device to detect a missing object from a designated section of a container.

Another object of this invention is to provide an alarm device that operates only in the absence of light when an object is missing from a designated section of the container.

Another object of this invention is to provide an alarm which will sound when light is present and an object is missing from a designated section of the container.

Still another object of this invention is to provide an alarm system for a wallet or billfold which allows the wallet or billfold to conform to the contour of the body of the user when carried in a hip pocket.

Still a further object of this invention is to provide an alarm system that is powered by light energy.

Still another object of this invention is to provide an alarm system which has a self generating power source.

Yet another object of this invention is to provide an alarm system which is simple in construction, economically inexpensive, durable and reliable in operation.

These together with other objects and advantages which will become subsequently apparent reside in the details of construction and operation as more fully hereinafter described and claimed, reference being had to accompanied drawings forming a part hereof, wherein like reference numerals refer to like parts or elements throughout, and in which:

DETAILED DESCRIPTION OF THE DRAWINGS

Figure 1:
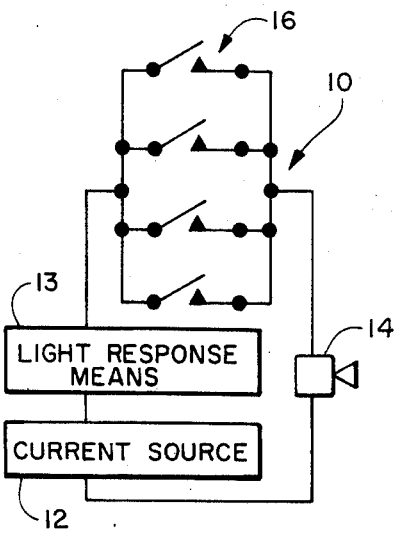
FIG. 1 is a circuit schematic of the alarm circuitry of the invention.

Referring now to the drawings, FIG. 1 is the electrical schematic of the alarm device 10 of the invention. The alarm device comprises a power source 12 with one electrical connection, shown as the positive connection, connected to a photovarister, photo relay or a light sensitive switch assembly 13 which may also include an inverter and the like and the other electrical connection connected to one connection of an audio alarm 14; the other side of the photovarister, photo relay or light sensitive switch assembly 13 connected to one side of a plurality of parallel wired switches 16. The other side of the switches 16 are connected to the other connection of the audio alarm 14.

The power source 12 can be a battery of the hearing aid, wrist watch or the like type which is readily available or a photovoltaic cell or the like which generates voltage when exposed to a light source.

The photovarister, photo relay or light sensitive switch assembly including the inverter (when required) are readily available. These devices control or switch between current conducting and non-conducting states in the presence or absence of light.

The audio alarm can be any low powered sound emitting device, for example, a piezoelective loudspeaker, a programmed solid state device, such as those used in "speaking" greeting cards or the like.

The parallel switches 16 are make (closed) and break (open) switches which are normally in the make condition. An example of the construction of these switches will be hereinafter discussed in more detail.

The circuit is designed to emit an audio sound when any one of the switches 16 are in their normally closed state and the photovarister, photo relay or light sensitive switch 13 is closed by the selected absence or presence of light energy.

Referring now to FIGS. 2–5, FIG. 3 shows a side view of one of the switches 16. The switch is positioned on one side of the bottom of a switch positioning bracket 18. On the opposite side of the bottom of the bracket is positioned a credit card support 17 which includes a slot 20 into which one end of the credit card 22 can be inserted.

Figure 4:
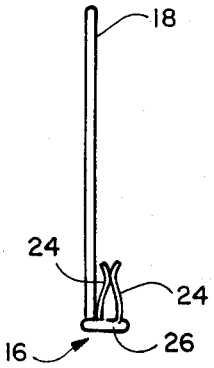
FIG. 4 is an end view of FIG. 3 taken along line 4—4.
Figure 5:
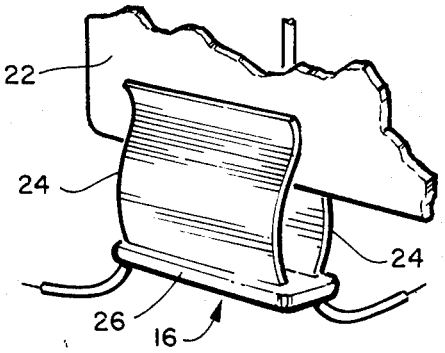
FIG. 5 is an enlarged showing of a switch contact.

Each of the switches 16 comprise a pair of opposed switch leafs 24 for receiving one end of the credit card therebetween. In the FIG. 5 showing the leafs are separated by the non-metallic credit card preventing current flow therebetween. In FIG. 4 the credit card is removed from between the switch leafs which provides for current flow therebetween. The switch leafs 24 may be constructed of any suitable material which has memory, such as bronze, copper or the like. The leafs are embedded in a rigid plastic base 26 or the like insulating material to hold them in then relative operating position.

Figure 6:
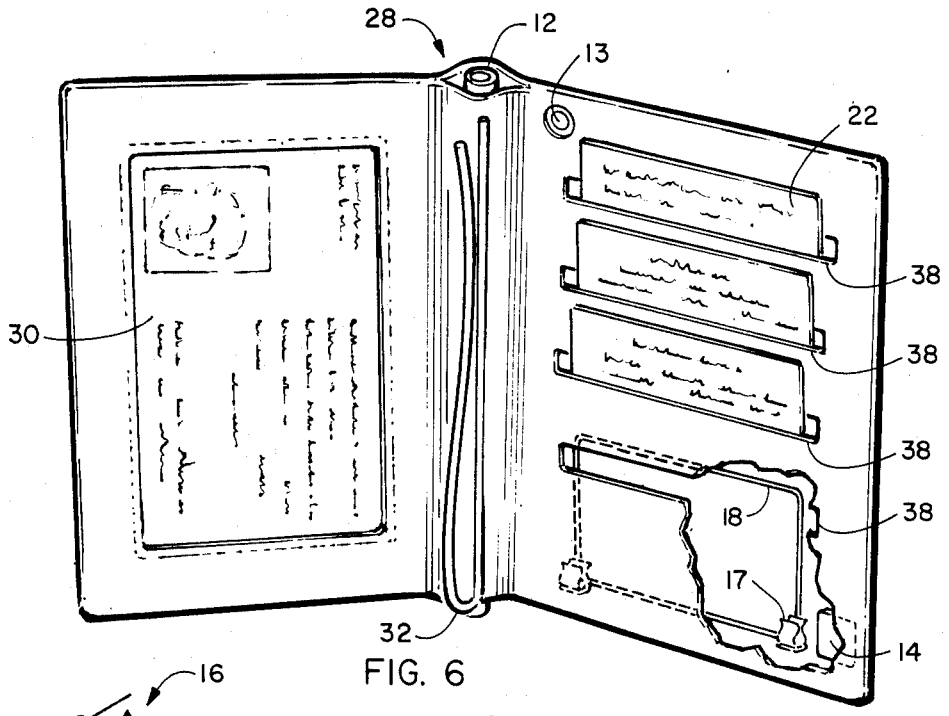
FIG. 6 is a perspective elevation view of a wallet or billfold employing the alarm device of the invention.

Referring now to FIG. 6, a typical wallet or billfold 28 is shown. A window portion 30 is positioned on one inside side typically for displaying a driver's license or the like. At the central portion a paper money clip 32 is held within a pocket (not shown) located at the hinge line of the wallet or billfold. The other portion of the wallet or billfold includes a plurality of staggered credit card slots 38. These slots extend into the space between the inner and outer wall surface and are deep enough so that just the upper surface of a credit card inserted therein is exposed.

Figure 2:
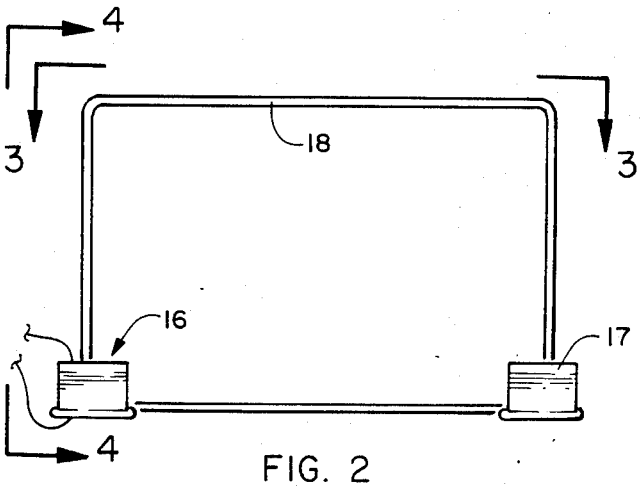
FIG. 2 is a side view showing of one of the cards switching devices of the invention.

To practice the invention, each slot 38 receives an assembly as shown in FIG. 2. An audio alarm 14 is positioned in the space between the wall surfaces as are the credit cards. The outside wall surface adjacent the audio emitting element surface of the audio alarm is perforated to allow sound energy to penetrate to the outer surface of the wallet. The power source 12 may be located at any convenient location, when the power source is a photovoltaic cell, the cell must be located where it will be exposed to light energy when credit cards are removed. The photovarister, photo relay or the light sensitive assembly 13 of the embodiment of FIG. 6 must be positioned on the inner surface of the wallet or billfold so that it will be exposed to light energy when the wallet or billfold is open for the purpose of removing a credit card as shown in the last mentioned Figure. These components are interconnected as shown in FIG. 1.

Figure 3:
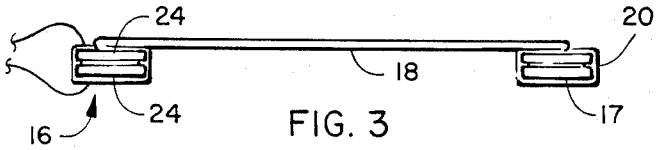
FIG. 3 is a view taken along line 3—3 of FIG. 2.

In operation the credit cards are inserted in each of the slots 38 so that the lower end surface of each card is inserted between the leafs of the switch and slot 20, see FIGS. 3 and 4. When the wallet is folded with the two portions together, photovarister, photo relay or the light sensitive assembly 13 is shielded from any light source, therefore, is in a closed state and all switches 16 are open and hence the alarm is inactive. When the wallet or billfold is opened as shown in FIG. 6, the photovarister, photo relay or the light sensitive switching assembly receives light energy and, therefore, is in an open state, when a card is removed one of the parallel switches 16 is closed. In this condition the alarm does not sound due to the photovarister, photo relay or the light sensitive assembly opening the electrical circuit between the power sources and audio alarm. If the credit card is returned to its assigned slot, switch 16 will be again open breaking the circuit along with the photovarister, photo relay or the light sensitive assembly 13. If, however, the removed card is not returned to its assigned slot and the sides of the wallet or billfold are folded together in the normal hip pocket insertable position the alarm will sound because the absence of light on the photovarister, photo relay or light sensitive assembly will close the circuit between the power sources and the audio alarm.

Figure 7:
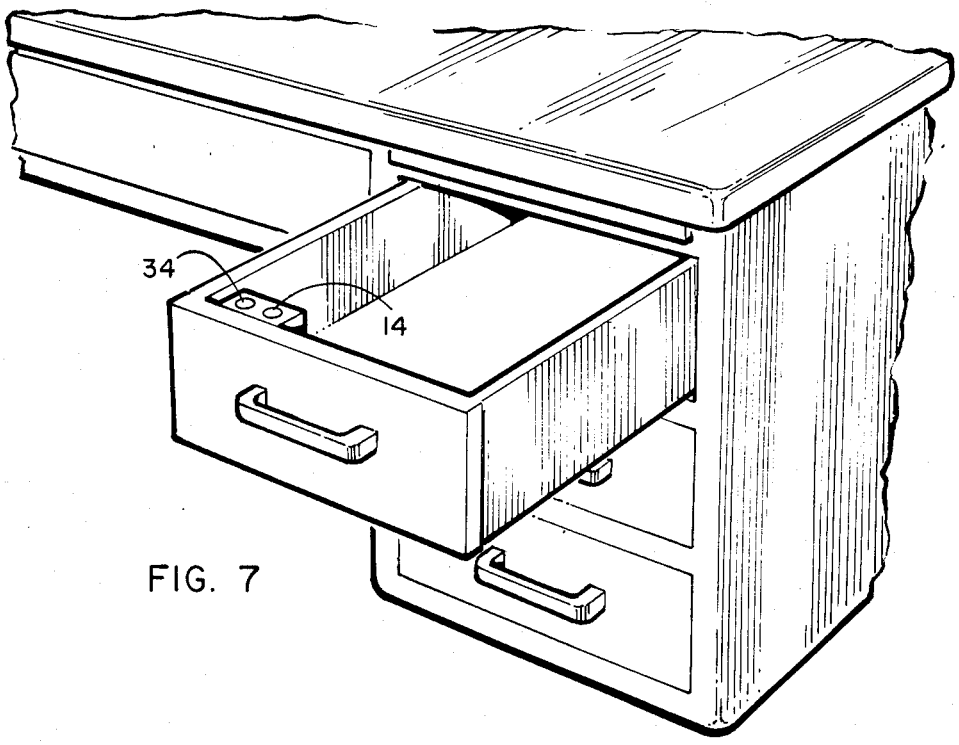
FIG. 7 shows an embodiment of the invention positioned in a drawer.

In the embodiment of FIG. 7, which may be used to detect the opening of a drawer of the like, the operation is the same as above discussed except switch 16 of the electrical circuit, see FIG. 1, will always be in a closed condition or wired in the equivalent of a closed switch 16 condition and the photovarister may be substituted as required by a photo switch assembly 34, readily available, which will close the circuit between the power source and audio alarm 14 in the presence of light energy.

Figure 8:
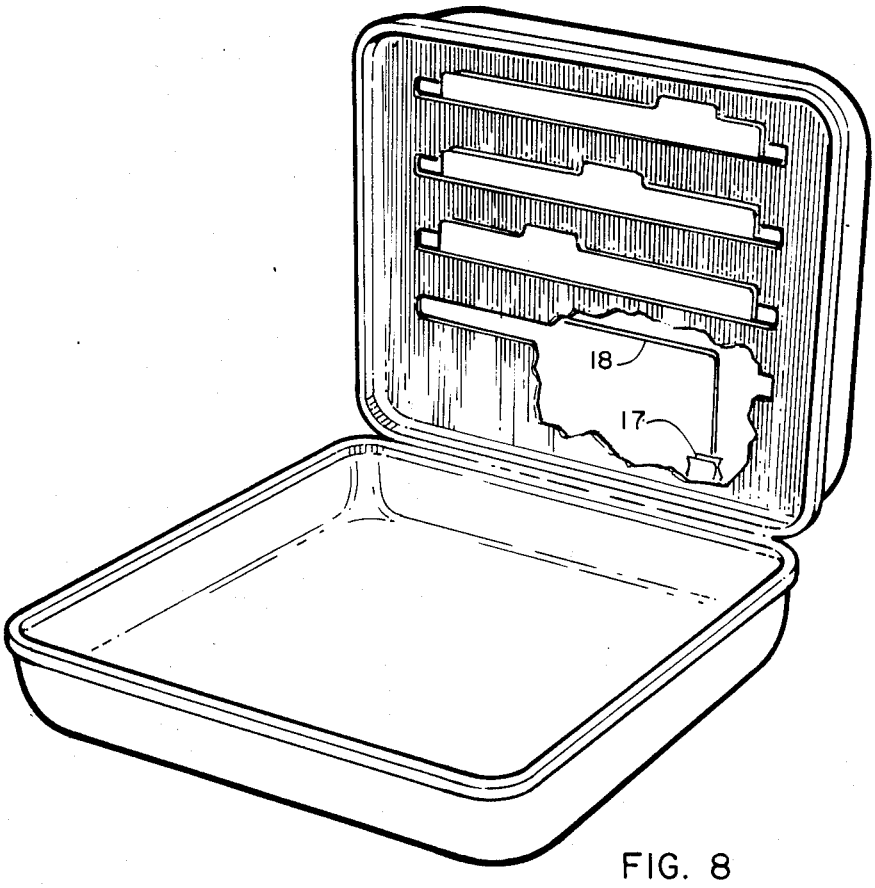
FIG. 8 shows an embodiment of the invention positioned in a briefcase.

In the embodiment of FIG. 8, which is used to detect the removal of objects from a briefcase is designed to receive and maintain credit cards as well as other flat objects such as important papers or the like and operates in the same manner as hereinbefore discussed.

Having thus described particular embodiments of the invention, it is to be understood that various changes can be made therein without departing from the spirit and scope of the invention as defined by the appended claims.

What is claimed is:

1. In a foldable wallet having two inner portions which fold together when said wallet is not in use and are unfolded when said wallet is in use, an alarm system for one of said portions comprising a credit card holder having a plurality of receptacles for receiving and maintaining credit cards, said alarm system comprising:

a plurality of switches, one of which is associated with each of said plurality of receptacles, said switches being switched to an open state when an object is received therein and being switched to a closed state when the object is removed therefrom;

a photoconductive means positioned in the inner portion of said foldable wallet, which inhibits current flow when exposed to light energy when the wallet unfolded and conducts current in the absence of light energy when the container is folded for non-use, a current source;

an audio alarm;

said plurality of switches, photoconductive means, current source and audio alarm being operatively interconnected so as to sound the audio alarm only when one or more of said plurality of switches are closed, by a removed credit card, and said wallet is in a folded non-use position wherein said photoconductive means receives no light energy.

2. The invention as defined in claim 1 wherein said current source is a battery.

3. The invention as defined in claim 1 wherein said photoconductive means is a photoelectric relay.

4. The invention as defined in claim 1 wherein said photoconductive means is a photovarister.

5. An alarm device comprising:

a container, the interior of which is exposed to light energy only when the container is opened;

a plurality of receptacles for receiving and maintaining objects;

a plurality of switches, one of which is associated with each of said plurality of receptacles, said switches being switched to an open state when an object is received therein and being switched to a closed state when the object is removed therefrom;

a photoconductive means positioned in the interior of said container which inhibits current flow when exposed to light energy when the container is open and conducts current in the absence of light energy when the container is closed;

a current source;

an audio alarm;

said plurality of switches, photoconductive means, current source and alarm being operatively interconnected so as to sound said audio alarm only when one or more of said plurality of switches are closed, by a removed object, and the container is closed.

6. The invention as defined in claim 5 wherein said container is a wallet.

7. The invention as defined in claim 5 wherein said container is a briefcase.

* * * * *